US008721020B2

(12) United States Patent
Akizuki et al.

(10) Patent No.: US 8,721,020 B2
(45) Date of Patent: May 13, 2014

(54) PRINTING DEVICE AND PRINTING METHOD

(75) Inventors: Masayuki Akizuki, Nagano-ken (JP); Masayuki Nakagawa, Nagano-ken (JP); Yoshiki Ushiyama, Nagano-ken (JP); Katsunori Takeuchi, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 372 days.

(21) Appl. No.: 13/075,307

(22) Filed: Mar. 30, 2011

(65) Prior Publication Data

US 2011/0254890 A1 Oct. 20, 2011

(30) Foreign Application Priority Data

Apr. 14, 2010 (JP) ..... 2010-093235

(51) Int. Cl.
*B41J 29/38* (2006.01)

(52) U.S. Cl.
USPC ..... 347/14; 347/5

(58) Field of Classification Search
USPC ..... 347/5, 14
See application file for complete search history.

(56) References Cited

U.S. PATENT DOCUMENTS 4,180,335 A * 12/1979 Yamada ..... 400/320
4,459,050 A * 7/1984 Goldberg et al. ..... 400/279
4,761,085 A * 8/1988 Angst et al. ..... 400/323
4,933,875 A * 6/1990 Kojima ..... 358/1.5
5,116,149 A * 5/1992 Yamasaki ..... 400/314.1
6,260,945 B1 * 7/2001 Niikura ..... 347/37
6,416,147 B1 * 7/2002 Li et al. ..... 347/9
6,827,511 B2 * 12/2004 Uchikata ..... 400/283
7,347,636 B2 * 3/2008 Jung ..... 400/303

FOREIGN PATENT DOCUMENTS

JP 04082763 A * 3/1992 ..... B41J 19/18
JP 06106808 A * 4/1994 ..... B41J 19/18
JP 10-109452 A 4/1998
JP 2002-160412 A 6/2002
JP 2004-034469 2/2004

* cited by examiner

*Primary Examiner* — Alessandro Amari
*Assistant Examiner* — Jeremy Bishop

(57) ABSTRACT

The throughput of a serial printer is improved. A inkjet printer 100 has a print unit that prints on a print medium; a first transportation unit that conveys the print medium in the primary scanning direction; a second transportation unit that conveys the print unit in a secondary scanning direction substantially perpendicular to the primary scanning direction; and a control unit that controls the transportation operations of the first and second transportation units, so that the time required to move the print unit from the stop-printing position where the print unit finishes printing one print area to the start-printing position where transportation for printing the next print area starts is shortest. The control unit also determines a transportation range that may include the print unit going beyond the stop-printing position when the print unit prints the one print area.

8 Claims, 19 Drawing Sheets

100

PRINTING DEVICE AND PRINTING METHOD

CROSS-REFERENCE TO RELATED APPLICATION(S)

The entire disclosure of Japanese Patent Application No. 2010-093235, filed on Apr. 14, 2010, is expressly incorporated by reference herein.

BACKGROUND

1. Technical Field

The present invention relates to a printing device and a printing method, and relates more particularly to a printing device and a printing method for printing on the surface of paper or other print medium.

2. Related Art

Line printers and serial printers that can print on different types of print media, including paper, cloth, and film, are known from the literature. See, for example, Japanese Unexamined Patent Appl. Pub. JP-A-2004-34469. One type of serial printer is an inkjet printer that has a transportation mechanism for conveying the print medium in a primary scanning direction, and a print head for printing on the print medium by reciprocally scanning the print medium in a secondary scanning direction while discharging ink onto the print medium. As a result of the print head executing the printing operation and the transportation mechanism executing the paper feed operation based on print data, the serial printer prints the print data for markings such as text and images one batch at a time in the secondary scanning direction (line direction) on the printing surface of the print medium. The print head of an inkjet printer is generally mounted on a carriage together with an ink cartridge, and the carriage travels bi-directionally in the secondary scanning direction over the print medium.

Logic-seeking control is one method used to move the print head more efficiently in printing operations. Logic-seeking control analyzes the print data to find white space (blank spaces), and skips over white space when moving the print head to the next print area. In order to print the next print area after the print head finishes printing one print area, another method moves the print head to the line end in the next print area that requires the print head to travel the shortest distance.

The time required for printing (the throughput) can be improved by using such a logic-seeking control method.

Depending upon the relative positions of the print areas, however, throughput may not be improved even when logic-seeking control is used. As a result, JP-A-2004-34469 discloses a method of moving in a short time from a stop-moving position where the print head stops after finishing printing one print area to a start-moving position where printing the next print area starts. However, because this method selects from among a limited number of optimal travel directions and travel speed settings from the stop-moving position to the start-moving position, improvement in the overall throughput of one print area and the next print area is limited. More specifically, the distance required for the motor and other components that move the print head to accelerate and decelerate is not considered.

SUMMARY

A first aspect of the invention is a printing device including: a print unit that prints on a print medium; a first transportation unit that conveys the print medium in a primary scanning direction; a second transportation unit that conveys the print unit in a secondary scanning direction substantially perpendicular to the primary scanning direction; and a control unit that controls the transportation operations of the first and second transportation units. When controlling the second transportation unit and conveying the print unit from a stop-printing position where the print unit finishes printing one print area to a start-printing position where printing the next print area starts, the control unit determines either or both a standby position where the print unit stops after printing the one print area, and a transportation range of the print unit, based on the distance needed to accelerate transportation of the second transportation unit.

The control unit also preferably considers if the standby position or the transportation range is past the stop-printing position.

By optimizing the position where transportation of the print unit stops after finishing printing one print area, or the transportation range of the print unit, based at least on the distance required for acceleration, the printing device according to this aspect of the invention can minimize the time required from the end of printing one print area to the start of printing the next print area by means of this acceleration even if the transportation range of the print unit becomes longer, and throughput can therefore be improved.

Further preferably in another aspect of the invention, when the transportation distance of the print unit from the standby position to the start-printing position is greater than or equal to a specified distance, the control unit sets the transportation speed of the print unit from the standby position to the start-printing position to a second transportation speed that is faster than a first transportation speed used to convey the print unit a distance shorter than the specified distance.

If the distance from the standby position to the start-printing position is sufficient as the distance (the specified distance) required for the motor or other means rendering the second transportation unit to accelerate to a high speed such as the second transportation speed, throughput can be improved by conveying the print unit at the second transportation speed. If in this scenario there is also sufficient distance to decelerate and stop at the standby position after printing the one print area, the distance needed for acceleration can be easily assured.

In a printing device according to another aspect of the invention, when the distance from the standby position to the start-printing position is shorter than the specified distance, the control unit preferably changes the standby position so that the distance from the standby position to the start-printing position is longer than the specified distance, controls the second transportation unit, and conveys the print unit past the stop-printing position to the changed standby position, and then conveys the print unit to the start-printing position at the second transportation speed.

If the distance from the standby position to the start-printing position is not sufficient for the motor or other means rendering the second transportation unit to accelerate to a high speed such as the second transportation speed, the print unit can be conveyed past the stop-printing position of the one print area to achieve the distance needed for the motor to accelerate, the print unit can be moved at the second transportation speed, and throughput can be improved.

Further preferably in another aspect of the invention, when the distance from the standby position to the start-printing position is shorter than the specified distance, the control unit calculates and compares the time required by two scenarios and selects the scenario with the shorter required time. In one scenario the print unit is conveyed from the standby position to the start-printing position at the first transportation speed. In the other scenario the standby position is changed so that the distance to the start-printing position is greater than the specified distance, and the print unit is conveyed past the stop-printing position to the standby position and is then conveyed at the second transportation speed to the start-printing position.

When the distance from the standby position to the start-printing position is shorter than the specified distance, this aspect of the invention can shorten the time required to move to the start-printing position.

In another aspect of the invention, when the distance from the standby position to the start-printing position is shorter than the specified distance, the control unit preferably calculates and compares the time required by a scenario in which the print unit is conveyed from the standby position to the start-printing position at the first transportation speed, and a scenario in which the standby position is changed and the print unit is conveyed using a combination of the first transportation speed and the second transportation speed, and selects the scenario with the shorter required time.

This aspect of the invention can further improve throughput using a speed combination with the shortest time.

In another aspect of the invention, the control unit preferably also considers a reversing operation for reversing the transportation direction of the print unit when determining the standby position or the transportation range.

In this case, the required time is preferably calculated so that at least the time required for the reversing operation is also included.

This aspect of the invention can further improve throughput because a more appropriate transportation pattern can be selected with consideration for deceleration and acceleration of the motor, the time required to stop, and various combinations of these times.

Further preferably in a printing device according to another aspect of the invention, when the location of the stop-printing position in the secondary scanning direction is within the range of the next print area in the secondary scanning direction, the control unit determines the standby position or the transportation range for different scenarios using the opposite ends of the next print area as the start-printing position, calculates the time required from the standby position to the start-printing position in each scenario, and selects the scenario with the shortest required time.

As a result, this aspect of the invention can select a more appropriate transportation pattern when the stop-printing position is within the range of the next print area in the secondary scanning direction, and can thereby further improve throughput.

Further preferably in another aspect of the invention, the control unit also considers the distance required to accelerate transportation of the print unit and the distance required to decelerate after acceleration, when determining the standby position or the transportation range.

Another aspect of the invention is a printing method including: determining either or both a standby position where a print unit stops after printing one print area, and a transportation range of the print unit, based on the distance needed to accelerate the print unit; and when scanning and printing the one print area on a print medium using the print unit, conveying the print unit from a stop-printing position where printing the one print area ends to a start-printing position where printing a next print area begins.

The method also preferably considers if the standby position or the transportation range is past the stop-printing position.

The method may also include execution of any of the various functionalities of the control unit described above.

Other objects and attainments together with a fuller understanding of the invention will become apparent and appreciated by referring to the following description and claims taken in conjunction with the accompanying drawings.

DETAILED DESCRIPTION OF EMBODIMENTS

Preferred embodiments of the present invention are described below with reference to the accompanying figures. The following embodiments, however, do not limit the scope of the accompanying claims, as all combinations of features described below are not necessarily essential to achieving the invention.

Figure 1:
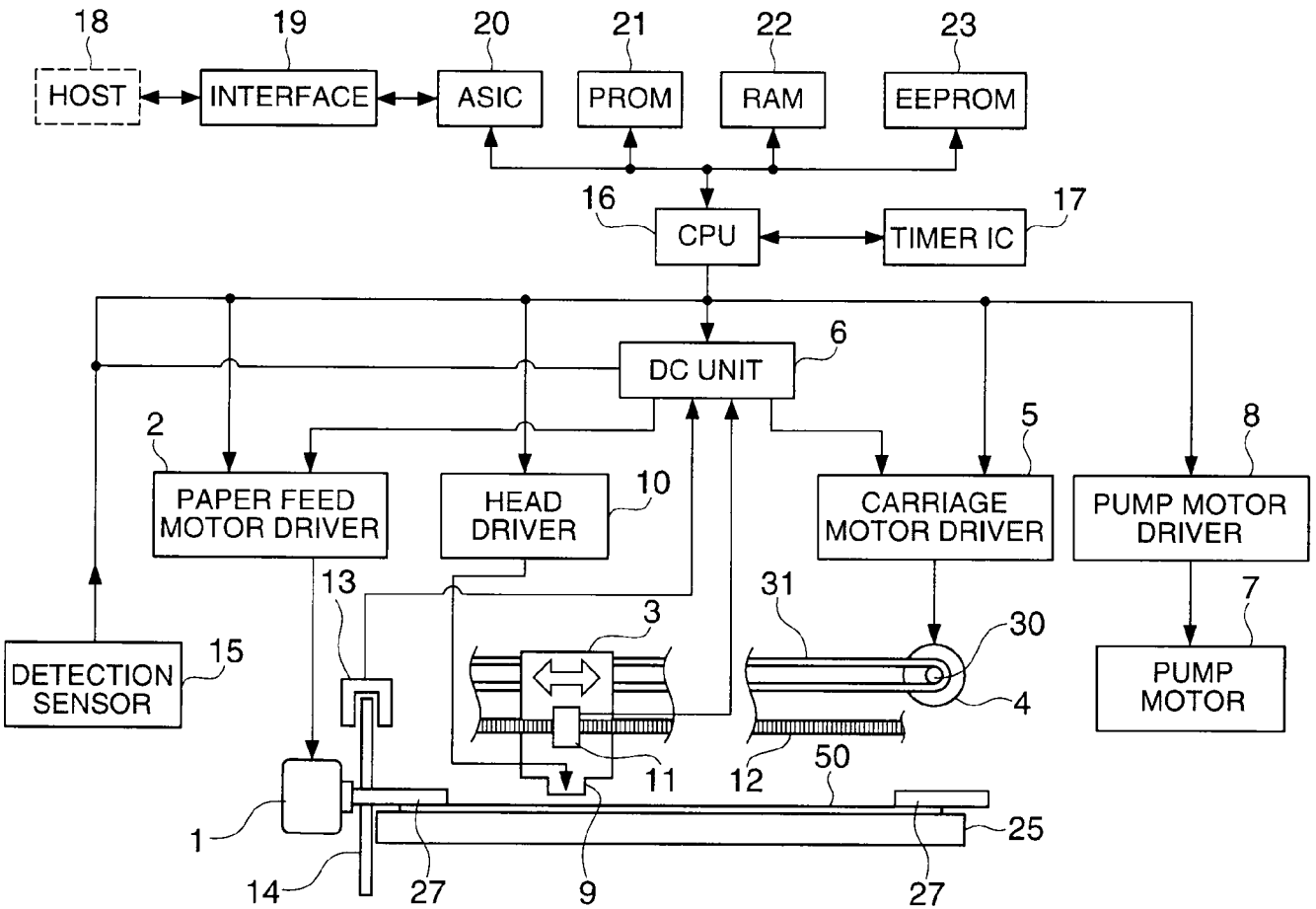
FIG. 1 is a block diagram of the configuration of an inkjet printer 100 according to a preferred embodiment of a printing device according to the invention.

FIG. 1 is a block diagram that schematically illustrates an inkjet printer 100 as an example of a preferred embodiment of a printing device according to the invention.

The inkjet printer 100 is an example of a printing device according to the invention, and as shown in FIG. 1 includes a paper feed motor 1, a paper feed motor driver 2, a carriage 3, a carriage motor 4, a carriage motor driver 5, a DC (direct current control) unit 6, a pump motor 7, a pump motor driver 8, a head driver 10, a linear encoder 11, a scale 12 for the linear encoder 11, a rotary encoder 13, a scale 14 for the rotary encoder 13, a detection sensor 15, a CPU 16, a timer 17, an interface 19, an ASIC 20, a PROM 21, RAM 22, and EEPROM 23, a platen 25, a transportation roller 27, a pulley 30, and a timing belt 31.

The paper feed motor 1 drives the transportation roller 27 using drive current supplied from the paper feed motor driver 2. The transportation roller 27 conveys the print medium 50 loaded in the inkjet printer 100 in a specific transportation direction (the primary scanning direction). The carriage motor 4 receives drive current supplied from the carriage motor driver 5, and rotationally drives a pulley 30 mounted on the motor shaft. The timing belt 31 is driven rotationally by the pulley 30, and conveys the carriage 3 in a direction (the secondary scanning direction) perpendicular to the primary scanning direction. In this embodiment of the invention the paper feed motor 1 and carriage motor 4 are both DC motors.

Based on a control signal from the CPU 16, and detection signals from the linear encoder 11, rotary encoder 13, and detection sensor 15, the DC unit 6 controls rotation of the paper feed motor 1 and carriage motor 4 by controlling the paper feed motor driver 2 and carriage motor driver 5.

The pump motor 7 receives drive current supplied from the pump motor driver 8, and performs an ink suction operation to prevent clogging of the print head 9 carried on the carriage 3. The print head 9 discharges ink onto the printing surface of the print medium 50.

The linear encoder 11 detects markings that are formed at a specific interval on a linear encoder scale 12, which is affixed to the carriage 3 and extends widthwise to the inkjet printer 100, and outputs detection signals to the DC unit 6.

The rotary encoder 13 detects markings that are formed at a specific interval on a disc-shaped rotary encoder scale 14, which is affixed to the paper feed motor 1, and outputs detection signals to the DC unit 6.

The detection sensor 15 detects the leading end and the trailing end of the print medium 50 to print.

The platen 25 supports the print medium 50 from below.

The CPU 16 controls inkjet printer 100 operations. The timer 17 periodically outputs an interrupt signal to the CPU 16. The interface 19 sends and receives data with the host 18. The ASIC 20 controls the print resolution and print head 9 drive waveform based on print data sent from the host 18 through the interface 19. PROM 21, RAM 22, and EEPROM 23 are used as work space and program storage space by the ASIC 20 and CPU 16.

The carriage 3 and the print head 9 disposed to the carriage 3 are an example of a print unit in the invention.

The mechanism that conveys the print medium 50 and includes the paper feed motor 1 and paper feed motor driver 2 is an example of a first transportation unit in the invention.

The mechanism that includes the carriage motor 4 and carriage motor driver 5 and transports the carriage 3 is an example of a second transportation unit in the invention.

The configuration that includes the CPU 16 and controls conveyance of the print medium 50 in the primary scanning direction and transportation of the carriage 3 in the secondary scanning direction is an example of a control unit in the invention.

Figure 2:
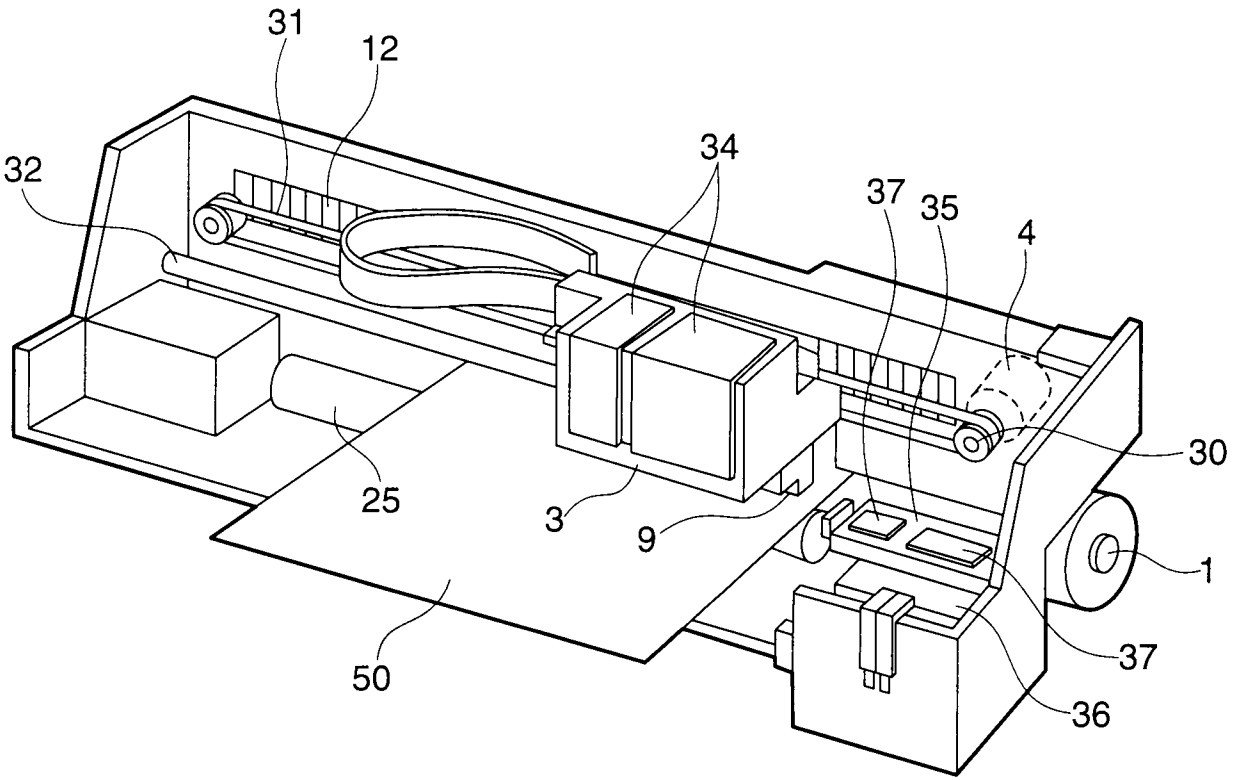
FIG. 2 is an oblique view of the area around the carriage 3 of the inkjet printer 100.

The configuration of the area around the carriage 3 is described next. FIG. 2 is an oblique view of the configuration around the carriage 3 of the inkjet printer 100.

As shown in FIG. 2, the carriage 3 is attached to a timing belt 31 mounted on a pulley 30, and as the pulley 30 turns moves widthwise to the inkjet printer 100 (in the secondary scanning direction) guided by a guide member 32. The print head 9 disposed to the side of the carriage 3 facing the print medium 50 has a nozzle row that ejects black ink and a nozzle row that ejects color ink. Each of the nozzles is supplied with ink from one of the ink cartridge 34 installed on the carriage 3, and discharges ink droplets onto the printing surface of the print medium 50 to print markings including text and images.

A space for applying the ink suction operation to the print head 9 is provided at one side of the inkjet printer 100 outside the print medium 50 transportation path. A capping device 35 for capping the nozzles of the print head 9, and a pump unit 36 including the pump motor 7 shown in FIG. 1, are disposed to this space. When the carriage 3 moves to this space, the carriage 3 contacts a lever not shown, and the capping device 35 rises and seals the print head 9.

The pump unit 36 is then operated while the print head 9 is sealed to suction ink from the nozzle rows by means of the negative pressure from the pump unit 36. This removes clogs formed in the nozzle rows of the print head 9. Paper dust and other foreign matter adhering to the area around the nozzle rows is also cleaned off, and air bubbles in the print head 9 are discharged with the ink into the cap 37. Note that this suction operation is performed whenever it is necessary to forcibly discharge ink from the print head 9, including, for example, immediately after the ink cartridge 34 is replaced.

Figure 3:
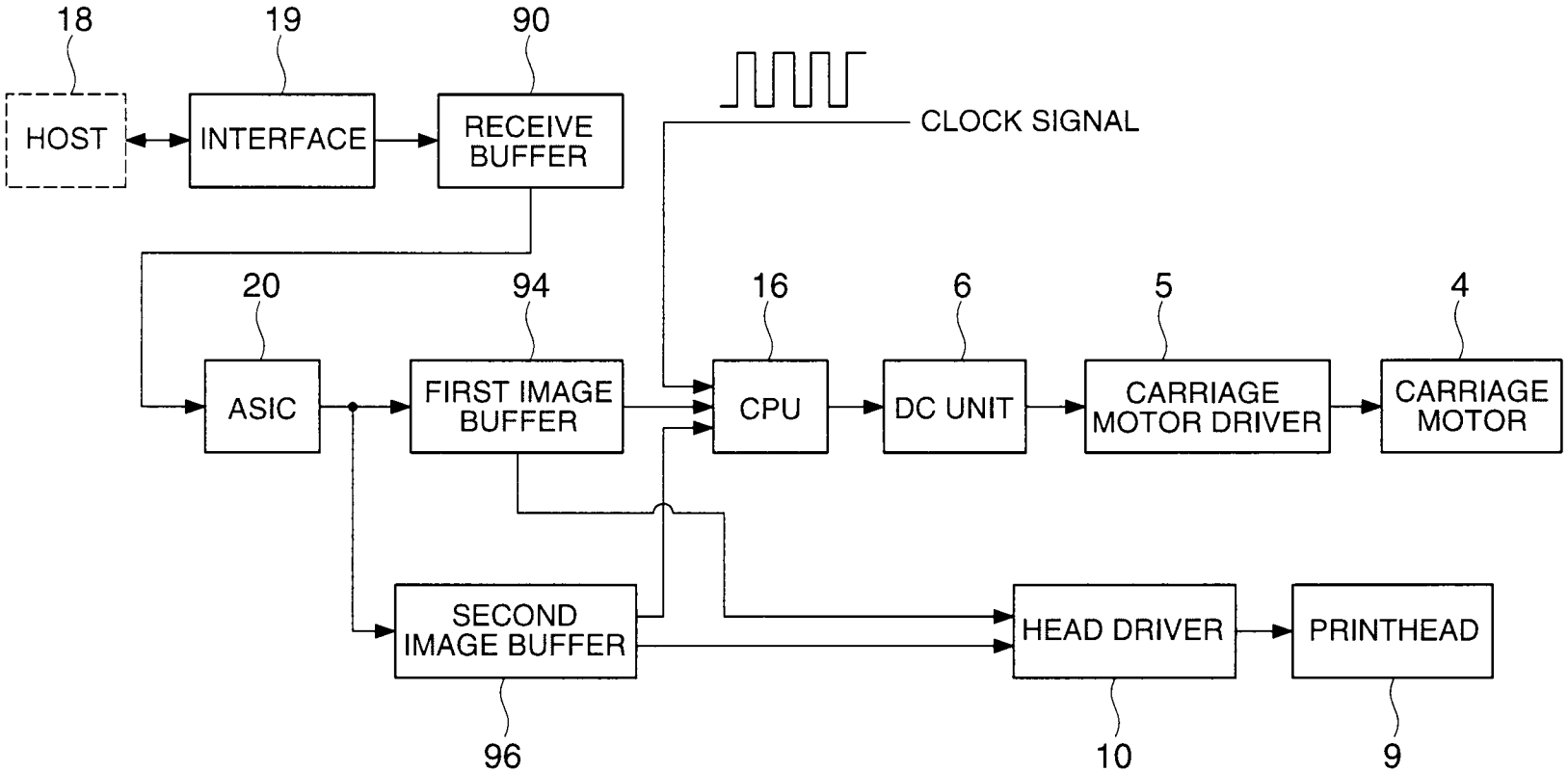
FIG. 3 schematically illustrates the flow of a printing process performed by the inkjet printer 100.

The printing operation of the inkjet printer 100 is described next. FIG. 3 schematically describes the flow of the printing process of the inkjet printer 100 based on print data sent from a host computer 18.

Print data that is generated by an application program that runs on the host computer 18 or by another external device is input from the host computer 18 to the inkjet printer 100. The print data input to the inkjet printer 100 includes, for example, raster data expressed as groups of dots containing color information, and data expressed by character codes or graphing functions. This print data is sequentially output from the host computer 18 as the unit data required to print a specific area of the print medium 50 (a "print area" herein), which may be the data for one, two, or more lines or a portion of the characters printed on one line.

The inkjet printer 100 receives the print data from the host computer 18 through the interface 19, and the ASIC 20 stores the print data in a receive buffer 90. The receive buffer 90 in this embodiment of the invention is rendered in memory such as RAM 22.

The ASIC 20 reads the print data from the receive buffer 90, and sequentially interprets and converts the print data to image data for specific print areas. More specifically, the ASIC 20 converts the interpreted print data to, for example, dot data, such as CMYK (cyan, magenta, yellow, black) raster data indicating whether or not a dot is formed at each specific interval in the secondary scanning direction, which is the direction in which the print head 9 disposed to the carriage 3 moves.

A plurality of image buffers 94, 96 are rendered separately from the receive buffer 90 in RAM 22 or other memory, and the image data converted from the print data by the ASIC 20 is individually stored for each print area in the image buffers 94, 96.

The CPU 16 checks the image buffers 94, 96 at specific times based on a check signal. The CPU 16 reads the image data stored in the image buffers 94, 96 and executes a printing process based on the image data.

In this printing process the CPU 16 identifies the print areas, excluding white space contained in the image data, on the printing surface of the print medium 50 based on the image data read from the image buffers 94, 96. The CPU 16 sets either one of the two ends of the identified print areas as the start-printing position, which is the position where the print head 9 starts printing the print area, and sets the other end as the stop-printing position, which is the position where printing stops.

Based on the stop-printing position of the immediate-previously print area, the CPU 16 sets the start-printing position and stop-printing position of the next print area.

When setting the start-printing position and stop-printing position of the next print area, the CPU 16 in this embodiment of the invention determines a transportation pattern and sets the start-printing position of the next print area based on the transportation pattern. The transportation pattern determines conditions for setting the transportation route and velocity of the carriage 3 from the completion of printing one print area to the start of printing the next print area. The transportation patterns are defined to also accommodate any need to accelerate and decelerate the carriage motor 4. Note that the CPU 16 also drives the paper feed motor driver 2 to rotate the paper feed motor 1 and index the print medium 50 in the primary scanning direction to the next line between the end of printing one print area and the start of printing the next print area.

More specifically, based on the relationship between the stop-printing position of the one print area and the positions of both sides of the next print area, the CPU 16 calculates the time required to move the carriage 3 to the start-printing position of the next print area for all of the transportation patterns that could be selected. The time required for the paper feed motor 1 to index the print medium does not directly affect the transportation time of the print head 9, and is therefore not considered when calculating the time required to move the print head 9. Note that if the print head 9 is not printing while moving, the paper feeding operation of the paper feed motor 1 can proceed simultaneously to print head 9 movement, thereby eliminating or shortening the time used only for the paper feed operation of the paper feed motor 1. The CPU 16 thus selects the transportation pattern that requires the shortest amount of time, and sets the start-printing position of the next print area to the position determined by the selected transportation pattern.

The CPU 16 then controls driving the carriage motor 4 by means of the DC unit 6 so that the carriage 3 is moved to the start-printing position of the next print area based on the selected transportation pattern, and the carriage 3 is accurately moved from the start-printing position to the stop-printing position of the print area. The CPU 16 also controls ink ejection by the print head 9 through the head driver 10 based on the read image data in conjunction with carriage 3 movement. As a result, text, images, or other markings described in the image data are printed in the print area on the print medium 50.

Because printing is not performed while the carriage 3 travels from the stop-printing position of the one print area to the start-printing position where movement to print the next print area starts, the CPU 16 can move the carriage 3 at a velocity Vac when the carriage 3 must be moved at least a specific distance that requires accelerating the carriage 3 to a velocity Vac that is faster than the normal velocity V0 used for printing and then decelerating to the normal velocity V0 before the start-printing position.

Therefore, as described in the specific examples below, when setting the transportation pattern of the carriage 3 from the stop-printing position of one print area to the start-printing position of the next print area, the CPU 16 includes as selection candidates transportation patterns that adjust the position of the reversing operation described herein to assure a linear transportation distance that is greater than or equal to a specified distance.

Note that transportation velocity V0 is an example of a first transportation velocity and transportation velocity Vac is an example of a second transportation velocity in the invention.

Specific examples of the process whereby the CPU 16 sets the transportation pattern of the carriage 3 is described next with reference to FIG. 4 to FIG. 9. FIG. 4 to FIG. 9 show scenarios assuming different combinations of the transportation direction in which the carriage 3 travels through the print area when printing one print area, labeled area X, and the relative position of the next area to be printed, which is labeled area Y.

Figure 4:
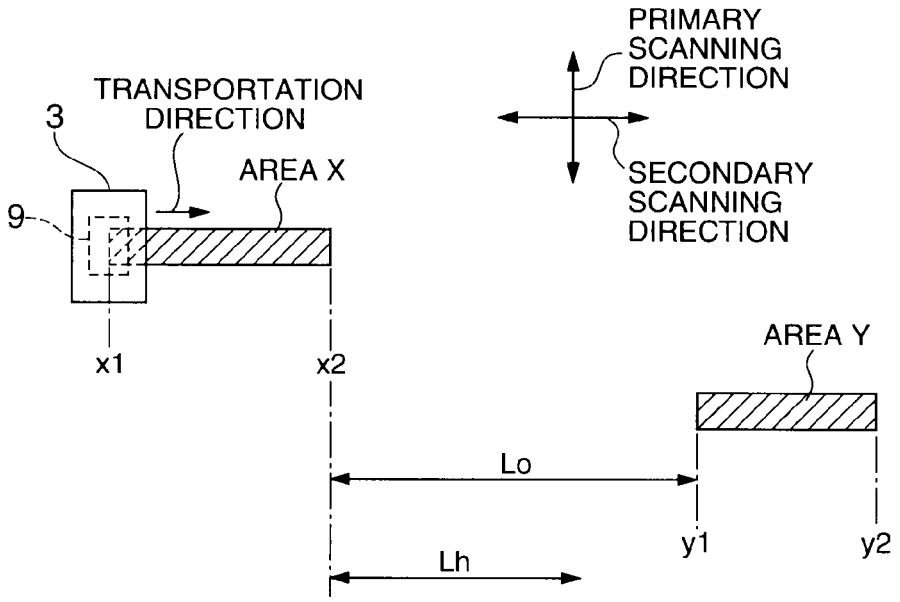
FIG. 4 shows a scenario assuming a particular direction of carriage 3 travel through the print area when printing one print area, and the relative positions of the one print area and the next print area.

FIG. 4 shows a scenario in which the print head 9 prints to area X while the carriage 3 travels from position x1 to position x2 in the direction of travel shown in the figure, and then prints area Y with the direction of carriage travel and the secondary scanning direction set to the same direction.

In this scenario, the distance Lo from the stop-printing position x2 of area X to position y1, which is the closer of the end positions y1 and y2 of area Y to area X, is greater than or equal to the distance Lh required for the carriage 3 to accelerate from the stop-printing position x2 to velocity Vac and then decelerate to the normal velocity V0 before position y1.

One transportation pattern applicable to this scenario sets position y1 as the start-printing position of area Y, accelerates the conveyance speed of the carriage 3 from the stop-printing position x2 of area X to a velocity Vac that is greater than velocity V0, and then decelerates the carriage 3 before reaching the start-printing position y1 of area Y, thereby enabling printing area Y to start in the shortest after printing area X ends.

A different transportation pattern that could be used in this scenario continues conveying the carriage 3 at velocity V0 to a position a distance (Lo-Lh) past the stop-printing position x2 without stopping the carriage 3 at the stop-printing position x2 when printing area X, and then if there is still sufficient distance to accelerate to velocity Vac and decelerate before the start-printing position, accelerates the paper feed motor driver 2 to velocity Vac and then stops.

The CPU 16 calculates and compares these transportation patterns and selects the one with the shortest time.

Note that this embodiment describes an embodiment in which the speed of the carriage 3 can be changed freely from the print velocity V0 at the stop-printing position x2 of area X, but the invention is not so limited. For example, a configuration that requires stopping carriage 3 movement (stopping the carriage motor 4) at the stop-printing position of area X and the start-printing position of area Y is also conceivable.

In this configuration the distances required for deceleration and acceleration before and after the carriage motor 4 stops are added to distance Lh. More specifically, if distance Lo is longer than distance Lh including these additional amounts, a transportation pattern that accounts for acceleration to velocity Vac is selected. These considerations also apply to the scenarios shown in the figures through FIG. 8 and described below.

Furthermore, when the carriage motor 4 must be decelerated to the print velocity V0 after reaching velocity Vac during travel to area Y, the CPU 16 calculates and compares the time needed to reach position y1 after starting movement with acceleration to velocity Vac, and the time required to reach position y1 after reaching velocity V0 without accelerating to velocity Vac, and selects the pattern requiring the least time.

These considerations also apply to the scenarios shown in the figures through FIG. 8 and described below.

In this scenario the CPU 16 of the inkjet printer 100 also sets position y1 of area Y as the start-printing position and position y2 as the stop-printing position based on the results of detecting the distance between area X and area Y and the end positions of both areas. The CPU 16 also sets the transportation pattern so that after printing area X ends the carriage 3 accelerates from the stop-printing position x2 of area X to velocity Vac and is conveyed to the start-printing position y1 of area Y.

Figure 5:
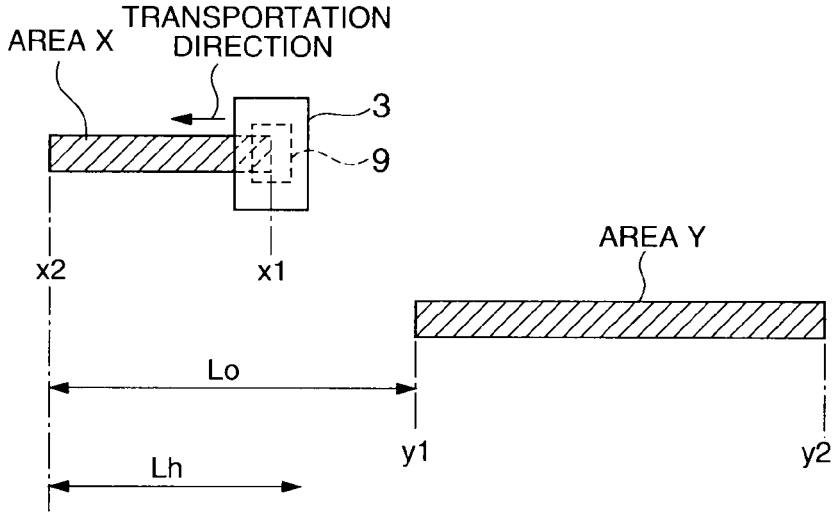
FIG. 5 shows another scenario assuming a particular direction of travel of carriage 3 through the print area when printing one print area, and the relative positions of the one print area and the next print area.

FIG. 5 shows a scenario in which the print head 9 prints to area X while the carriage 3 travels from position x1 to position x2 in the direction of travel shown in the figure, and then prints area Y with the direction of carriage travel and the secondary scanning direction set to the opposite direction.

This scenario is different from that shown in FIG. 4 in that the direction of carriage 3 travel must be reversed after printing area X. As in the scenario in FIG. 4, the distance Lo from the stop-printing position x2 of area X to the nearest end y1 of area Y having end positions y1 and y2 is distance Lh, which is the distance required to accelerate the carriage 3 to velocity Vac, and thus is greater than or equal to the distance Lh at which the carriage 3 can be conveyed at velocity Vac. In this scenario, therefore, printing area Y can start in the shortest time after printing area X ends by setting position y1 as the start-printing position of area Y, reversing the direction of carriage 3 travel at the stop-printing position x2 of area X, and then conveying the carriage 3 at velocity Vac to the start-printing position y1 of area Y.

As shown in FIG. 4, these scenarios describe cases in which decelerating and accelerating to pause the carriage motor 4 after printing area X ends and before printing area Y starts, and decelerating the carriage motor 4 from velocity Vac to the print velocity V0 before the start-printing position of area Y, are not necessary. However, if decelerating at either position is necessary, the distance required for deceleration is added to distance Lh.

Furthermore, when the carriage motor 4 must be decelerated to the print velocity V0 after reaching velocity Vac during travel to area Y, the CPU 16 calculates and compares the time needed to reach position y1 after starting movement with acceleration to velocity Vac, and the time required to reach position y1 after reaching velocity V0 without accelerating to velocity Vac, and selects the pattern requiring the least time.

In this scenario the CPU 16 of the inkjet printer 100 also sets position y1 of area Y as the start-printing position and position y2 as the stop-printing position based on the results of detecting the distance between area X and area Y and the end positions of both areas. The CPU 16 also sets the transportation pattern so that after printing area X ends the direction of carriage 3 travel is reversed, and the carriage 3 travels at velocity Vac from the stop-printing position x2 of area X to the start-printing position y1 of area Y.

Figure 6:
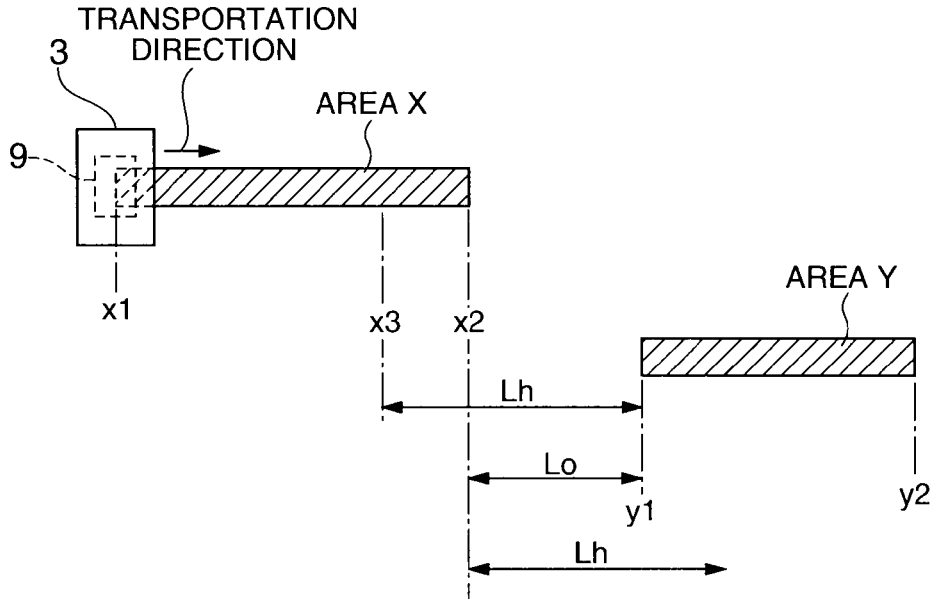
FIG. 6 shows another possible scenario assuming a particular direction of travel of carriage 3 through the print area when printing one print area, and the relative positions of the one print area and the next print area.

FIG. 6 shows a scenario in which the print head 9 prints to area X while the carriage 3 travels from position x1 to position x2 in the direction of travel shown in the figure, and then prints area Y with the direction of carriage travel and the secondary scanning direction set to the same direction. This scenario differs from that shown in FIG. 4 in that the distance between area X and area Y is different.

In this scenario the distance Lo from the stop-printing position x2 of area X to the nearest end y1 of the end positions y1 and y2 of area Y is shorter than the distance Lh required for the carriage 3 to accelerate to velocity Vac and then decelerate before the start-printing position of area Y. Therefore, when position y1 is the start-printing position of area Y, the following two patterns can be selected as candidate transportation patterns for conveying the carriage 3 from the stop-printing position x2 of area X to the start-printing position y1 of area Y after printing area X ends.

The first selection candidate is a transportation pattern that conveys the carriage 3 at the normal print velocity V0 to the start-printing position y1 of area Y either after stopping or not stopping at the stop-printing position x2 of area X.

The second selection candidate is a transportation pattern that reverses the direction of carriage 3 travel at the stop-printing position x2 of area X, then moves the carriage 3 to a position x3 separated distance Lh from the start-printing position y1 of area Y at the normal print velocity V0 to achieve distance Lh to the start-printing position y1, again reverses the direction of travel at this position x3, and then accelerates to velocity Vac and conveys the carriage 3 to before the start-printing position y1 of area Y.

However, because the distance from the stop-printing position x2 of area X to position y2 of area Y is greater than or equal to the distance Lh enabling conveying the carriage 3 at velocity Vac as shown in FIG. 6, another candidate transportation pattern selects position y2 as the start-printing position of area Y, conveys the carriage 3 after printing area X ends from the stop-printing position x2 of area X to the start-printing position y2 of area Y at velocity Vac, then reverses the direction of carriage 3 travel to the printing direction area Y and starts printing from position y2.

In this scenario, the CPU 16 of the inkjet printer 100 calculates the time required by each of the transportation patterns that are selection candidates based on the results of detecting the distance between area X and area Y and the end positions of both areas, identifies the transportation pattern that can start printing area Y in the shortest after the end of printing area X, and selects that transportation pattern for use. In addition to setting the transportation pattern, the CPU 16 also sets position y2 as the stop-printing position if the selected transportation pattern uses position y1 as the start-printing position of area Y, and sets position y1 as the stop-printing position if position y2 is the start-printing position of area Y.

When as in this scenario the plural transportation patterns that could be selected include a transportation pattern that requires a reversing operation to reverse the direction of carriage 3 travel before printing area Y starts, a transportation pattern that requires a direction of travel reversing operation requires more time than a transportation pattern that does not require reversing the direction of carriage 3 travel even if the distance of carriage 3 travel is the same in the plural patterns because of the time lost by decelerating and stopping to reverse direction (during which time paper feed may proceed) and then accelerating again. This time can be shortened if decelerating is unnecessary.

Therefore, when calculating the time required by each transportation pattern, the CPU 16 also calculates the time required to reverse the direction of carriage 3 travel. As a result, a transportation pattern that can start printing area Y in the shortest time including the time required to reverse the carriage 3 after printing area X ends can be selected.

Figure 7:
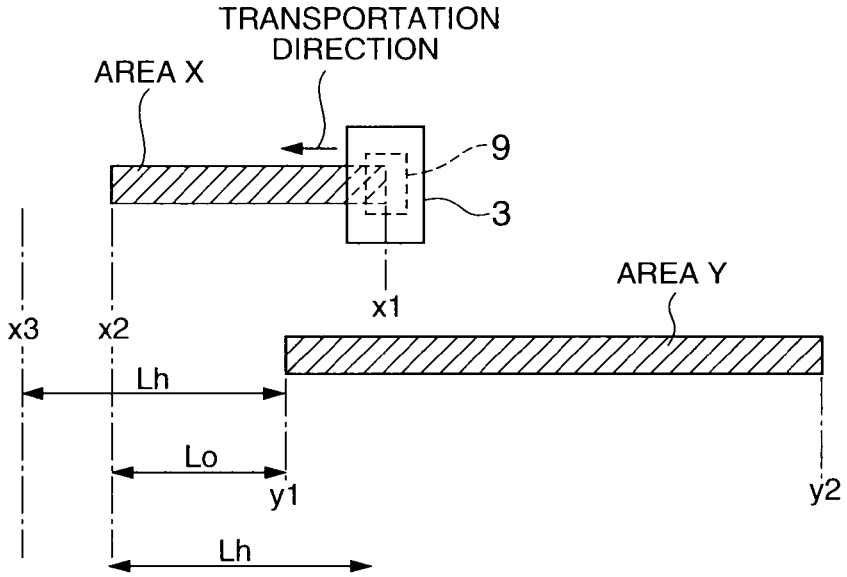
FIG. 7 shows another possible scenario assuming a particular direction of travel of carriage 3 through the print area when printing one print area, and the relative positions of the one print area and the next print area.

FIG. 7 shows a scenario in which the print head 9 prints to area X while the carriage 3 travels from position x1 to position x2 in the direction of travel shown in the figure, and then prints area Y with the direction of carriage travel and the secondary scanning direction set to the opposite direction.

This scenario is different from that shown in FIG. 6 in that the direction of carriage 3 travel must be reversed after printing area X. As in the scenario in FIG. 6, the distance Lo from the stop-printing position x2 of area X to the nearest end y1 of area Y having end positions y1 and y2 is shorter than distance Lh, which is the distance required to accelerate the carriage 3 to velocity Vac and then decelerate before position y1. In this scenario, therefore, printing area Y can start in the shortest time after printing area X ends by setting position y1 as the start-printing position of area Y, reversing the direction of carriage 3 travel at the stop-printing position x2 of area X, and then conveying the carriage 3 at velocity Vac to the start-printing position y1 of area Y. Therefore, when position y1 is the start-printing position of area Y, the following two patterns can be selected as candidate transportation patterns for conveying the carriage 3 from the stop-printing position x2 of area X to the start-printing position y1 of area Y after printing area X ends.

A first selection candidate is a transportation pattern that reverses the direction of carriage 3 travel at stop-printing position x2 after printing area X ends, and then conveys the carriage 3 at the normal print velocity V0 from the stop-printing position x2 to the start-printing position y1 of area Y.

A second selection candidate is a transportation pattern that conveys the carriage 3 after printing the area X ends to a position x3 separated distance Lh from the start-printing position y1 of area Y, then reverses the direction of carriage 3 travel at position x3, and then moves at velocity Vac to the start-printing position y1 of area Y.

However, because the distance from the stop-printing position x2 of area X to position y2 of area Y is greater than or equal to the distance Lh enabling moving the carriage 3 at velocity Vac as shown in FIG. 7, and even if this distance is substantially equal to distance Lh, another selection candidate is a transportation pattern that sets position y2 as the start-printing position of area Y, reverses the direction of carriage 3 travel at stop-printing position x2 after printing area X ends, then accelerates to velocity Vac and conveys the carriage 3 to the start-printing position y2 of area Y, again reverses the transportation direction at start-printing position y2, and starts printing from position y2.

In this scenario, the CPU 16 of the inkjet printer 100 also calculates the time required by each of the transportation patterns that are selection candidates based on the results of detecting the distance between area X and area Y and the end positions of both areas, identifies the transportation pattern that can start printing area Y in the shortest after the end of printing area X, and selects that transportation pattern for use. Based on the selected transportation pattern, the CPU 16 also sets either position y1 or position y2 of area Y as the start-printing position of area Y, and sets the other as the stop-printing position.

In the scenarios described above with reference to FIG. 4 to FIG. 7, there is distance in the secondary scanning direction and no overlap between the stop-printing position of one print area (area X) and the next print area (area Y). A scenario in which the stop-printing position of one print area overlaps the next print area in the secondary scanning direction is described next. In addition, because the recording medium is conveyed for indexing between printing the one print area (area X) and printing the next print area (area Y, there is a gap between the print areas in the primary scanning direction and the printed results do not overlap in each of the scenarios shown in FIG. 4 to FIG. 8.

Figure 8:
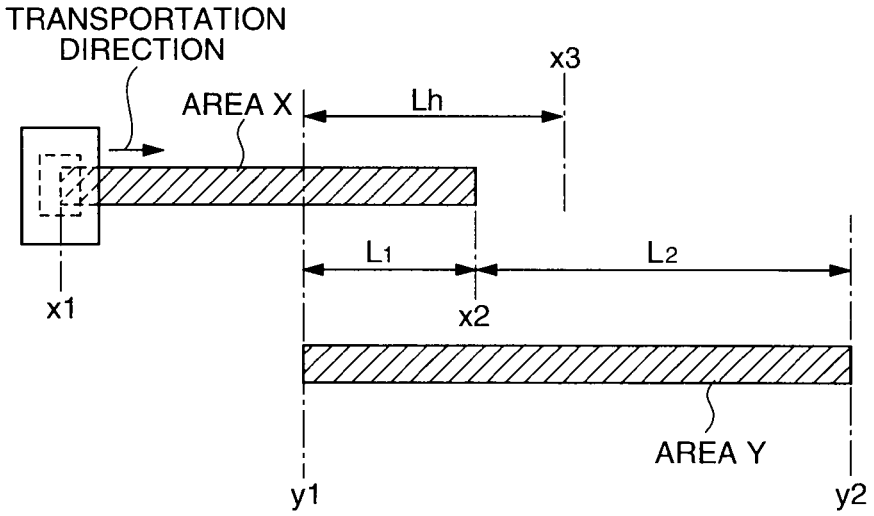
FIG. 8 shows another possible scenario assuming a particular direction of travel of carriage 3 through the print area when printing one print area, and the relative positions of the one print area and the next print area.

FIG. 8 shows a scenario in which the print head 9 prints to area X while the carriage 3 travels from position x1 to position x2 in the direction of travel shown in the figure, and then prints an area Y that is set to a position overlapping the stop-printing position x2 in the secondary scanning direction.

Because the stop-printing position x2 of area X is between the end positions y1 and y2 of area Y in the secondary scanning direction in this scenario, the selection candidates include transportation patterns that use end position y1 and patterns that use position y2 of area Y as the start-printing position. In this case, the distance L1 from the stop-printing position x2 of area X to position y1 of area Y is shorter than the distance Lh needed to accelerate the carriage 3 to velocity Vac and then decelerate before position y1, and the distance L2 from the stop-printing position x2 of area X to position y2 of area Y is greater than or equal to Lh. Therefore, when position y1 is the start-printing position of area Y, the following two transportation patterns are selection candidates.

More specifically, a first selection candidate is a transportation pattern in which after the direction of carriage 3 travel is reversed at the stop-printing position x2 of area X, the carriage 3 is conveyed at the normal print velocity V0 from the stop-printing position x2 to the start-printing position y1 of area Y.

A second selection candidate is a transportation pattern in which after printing area X ends the carriage 3 is conveyed at the normal print velocity V0 past the stop-printing position x2 to a position x3 separated distance Lh from the start-printing position y1 of area Y, the direction of travel is then reversed at this position x3, and the carriage 3 is then accelerated to velocity Vac and conveyed to the start-printing position y1 of area Y.

When position y2 is the start-printing position of area Y, a transportation pattern that after printing area X ends accelerates to and conveys the carriage 3 in the same transportation direction past the stop-printing position x2 of area X to the start-printing position y2 of area Y, then reverses the transportation direction to the printing direction of area Y, and starts printing from position y2 is also a selection candidate.

In this scenario, the CPU 16 of the inkjet printer 100 calculates the time required by each of the transportation patterns that are selection candidates based on the results of detecting the distance between area X and area Y and the end positions of both areas, identifies the transportation pattern that can start printing area Y in the shortest after the end of printing area X, and selects that transportation pattern for use. In addition, the CPU 16 sets either position y1 or position y2 of area Y as the start-printing position of area Y based on the selected transportation pattern, and sets the other as the stop-printing position.

Throughput can thus be improved with the inkjet printer 100 according to this embodiment of the invention because the transportation pattern with the shortest required time from the end of printing one print area to the start of printing the next print area is selected from among a plurality of transportation patterns in which the stopping position after printing one print area ends and the start-printing position of the next print area vary. Stopping at a position past the stop-printing position x2 of area X is also possible in these transportation patterns.

Figure 9:
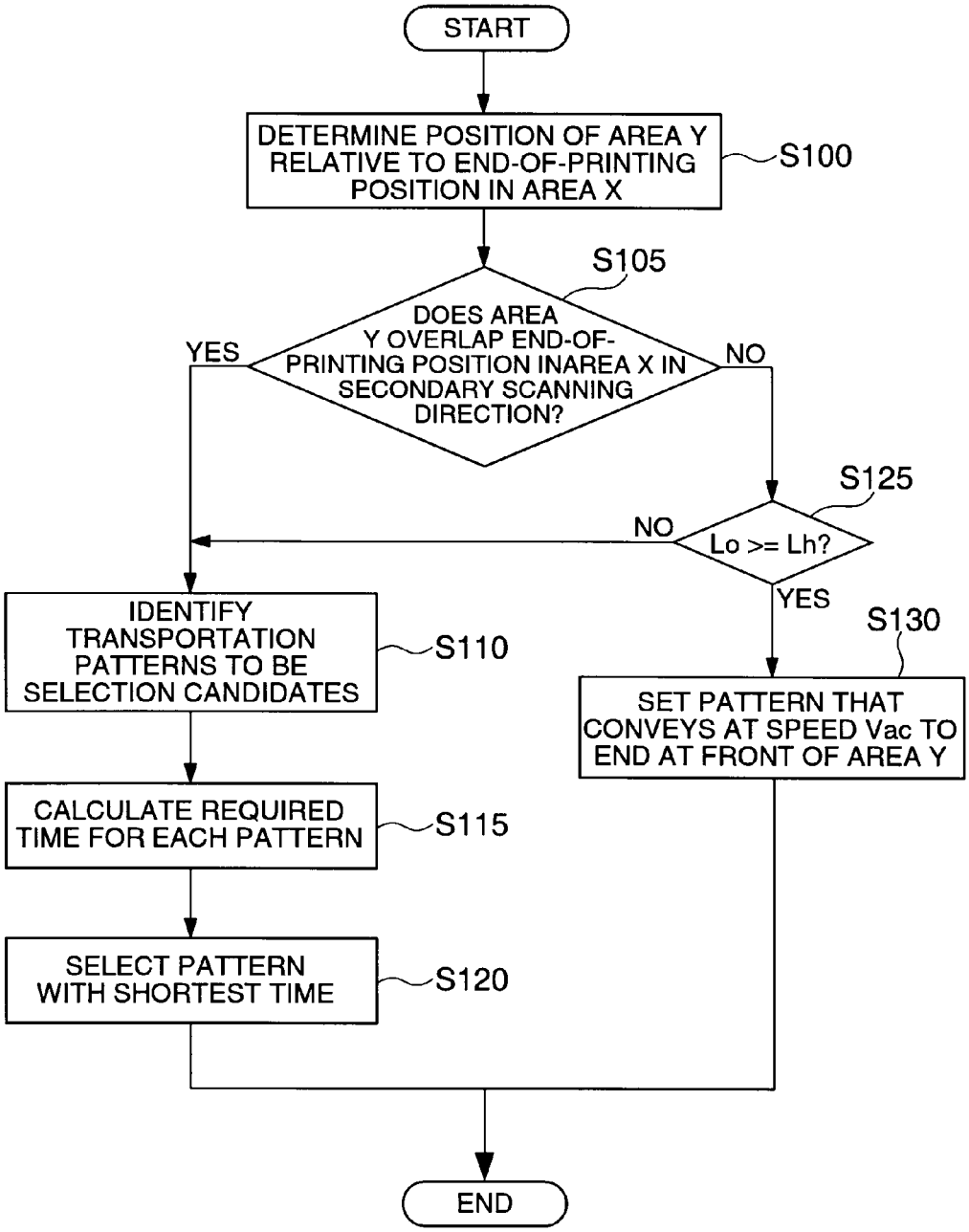
FIG. 9 is a flow chart of the process whereby the CPU 16 sets the transportation pattern when the inkjet printer 100 sequentially prints area X and area Y on the printing surface of the print medium 50.

FIG. 9 is a flow chart of the process whereby the CPU 16 sets the transportation pattern when the inkjet printer 100 sequentially prints area X and area Y on the printing surface of the print medium 50.

The first step in this process is determining the position of area Y, which is the next print area, in relation to the stop-printing position of area X (step S100). If area Y is set to a position overlapping area X in the secondary scanning direction (step S105 returns Yes), all transportation patterns that are potential selection candidates using one of both ends of area Y as the start-printing position of area Y are identified (step S110). Transportation patterns that stop the print head 9 after passing the stop-printing position x2 of area X, and transportation patterns that convey the print head 9 in the transportation direction resulting in distance Lo being equal to distance Lh or greater than distance Lh before printing area Y, are also included as selection candidates.

The time required to convey the carriage 3 to the start-printing position of area Y is also calculated for each of the identified transportation patterns (step S115). Any acceleration or deceleration time required for velocity V0 and velocity Vac is also considered in this calculation. The transportation pattern that requires the least time is then set as the transportation pattern for conveying the carriage 3 from the stop-printing position of area X to the start-printing position of area Y (step S120).

If area Y is set to a position separated from area X in the secondary scanning direction (step S105 returns No), and the distance Lo from the stop-printing position of area X to the position of the near end of area Y (the posit ion nearest the stop-printing position of area X) is greater than or equal to the minimum distance Lh required to convey the carriage 3 at a velocity Vac faster than the normal print velocity V0 (step S125 returns Yes), this end position is set as the start-printing position of area Y, and the transportation pattern is set so that the carriage 3 accelerates from the stop-printing position of area X to velocity Vac and is conveyed to the start-printing position of area Y (step S130).

If the distance Lo from the stop-printing position of area X to this end position of area Y is less than distance Lh (step S125 returns No), either end of area Y could be used as the start-printing position of area Y, and all transportation patterns that are viable selection candidates using one of these end positions as the start-printing position of area Y are selected (step S110). The time required to convey the carriage 3 to the start-printing position of area Y is then calculated for each of the identified transportation patterns (step S115), and the transportation pattern with the shortest required time is selected (step S120).

The process whereby the CPU 16 selects the transportation pattern of the carriage 3 is described in further detail below with reference to FIG. 10 to FIG. 21.

Figure 10:
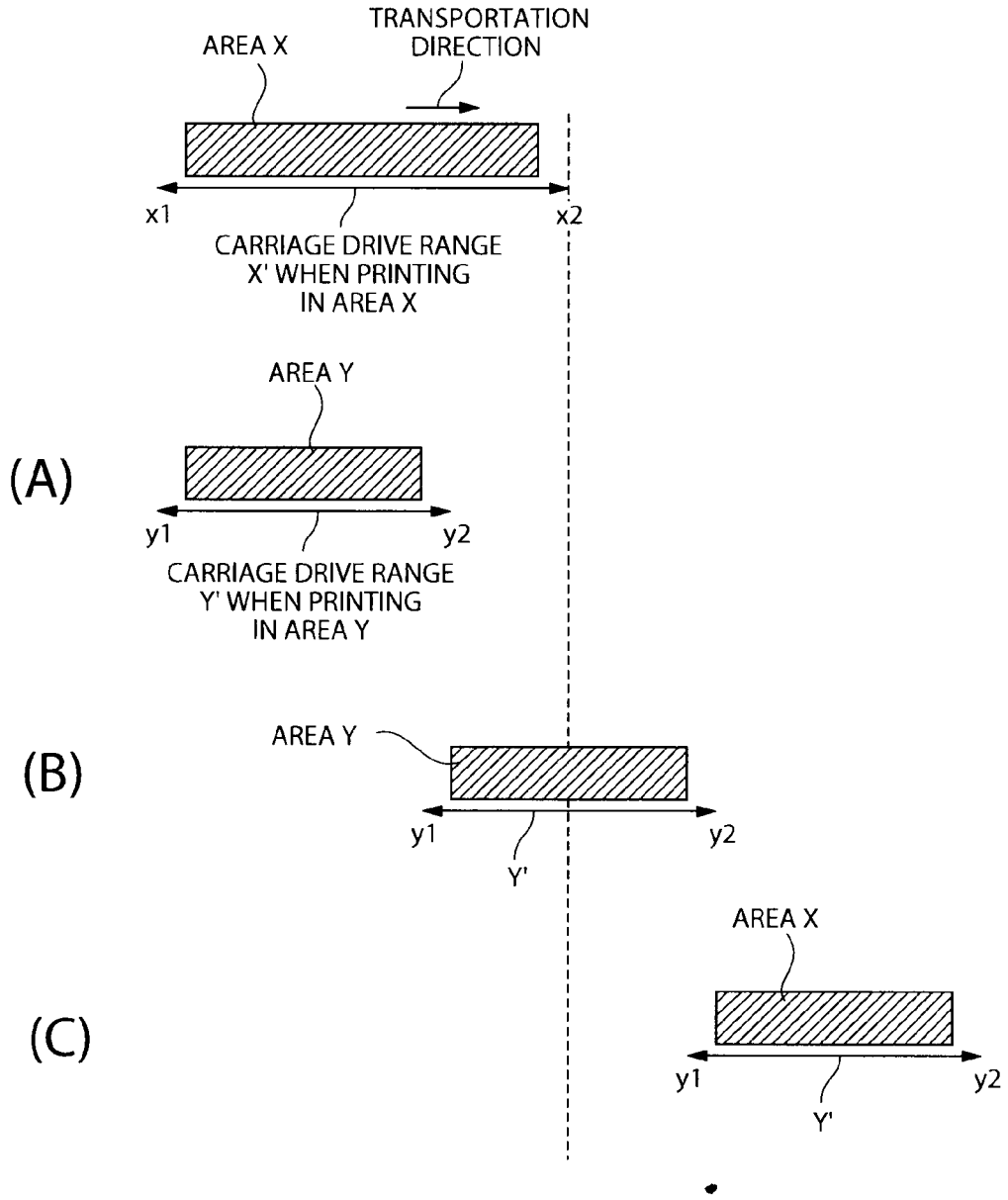
FIG. 10 shows a pattern for various scenarios assuming a particular direction of carriage 3 travel when printing area X, and the position relative to the next print area Y.

FIG. 10 shows a pattern for a scenario assuming a particular direction in which the carriage 3 is conveyed through the print area when printing one print area (area X), and the relative position of the next area (area Y) to be printed. FIG. 11 to FIG. 21 show specific examples of the relative positions of area X and area Y in various iterations of the general pattern shown in FIG. 10, and the relationship between the speed and conveyance position of the carriage 3 when printing area Y. Note that in the time between the end of printing area X and the start of printing area Y the paper feed motor driver 2 is driven to drive the paper feed motor 1 and effect a line feed advancing the print medium 50 one line in the primary scanning direction. The time required for the paper feed operation of the paper feed motor 1 does not directly affect the transportation time of the print head 9, and is therefore omitted from the time calculations. Note that if the print head 9 is not printing at the same time it is moving, the paper feed motor 1 can execute the paper feed at the same time and the time required only for the paper feed operation of the paper feed motor 1 can be eliminated or shortened.

In FIG. 10 to FIG. 21, the drive ranges of the carriage 3 including the transportation distance required to accelerate the carriage 3 by means of the carriage motor 4 from a stopped position to transportation velocity V0, or to decelerate from print velocity V0, when printing area X or area Y are respectively denoted X' and Y'.

The end positions of carriage 3 drive range X' when printing area X, or more specifically the start-driving position of the carriage 3 when printing area X and the stop-driving position (standby position) after printing area X is completed are denoted x1 and x2. The start-driving position and stop-driving position of the carriage 3 when printing area Y are similarly denoted y1 and y2.

As shown in FIG. 10, the transportation direction of the carriage 3 when printing area Y (referred to below as the "area Y print direction") belongs to one of three basic patterns depending upon the relative positions of area X and the area Y printed next. More specifically, these patterns are: (A) the area Y print direction is the opposite of the carriage 3 transportation direction when printing area X (referred to below as the "area X print direction") (that is, area Y is printed in the opposite direction as area X), (B) the area Y print direction and the area X print direction may be the same or opposite directions, and (C) the area Y print direction is the same as the area X print direction (area X and area Y are printed in the same direction of travel).

Figure 11:
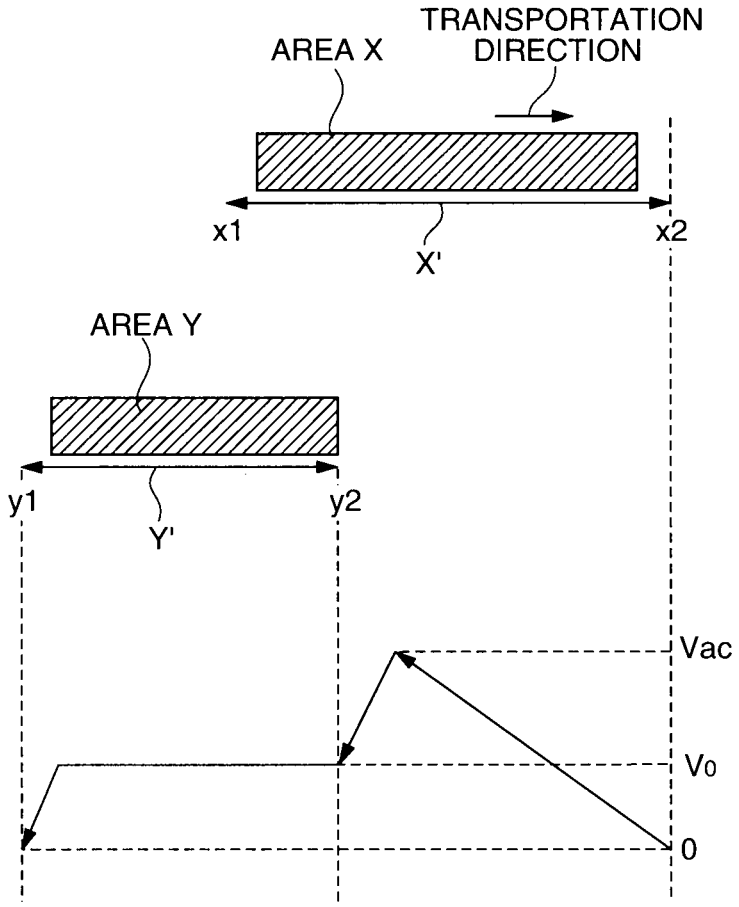
FIG. 11 shows an example of the specific relative positions of area X and area Y in a pattern in which area X and area Y are printed in opposite directions, and the relationship between the conveyance position and velocity of the carriage 3 when printing area Y.

Of these three patterns, pattern (A) whereby area X and area Y are printed in opposite directions is considered first below. As shown in FIG. 11, if the distance from the stop-driving position x2 of the carriage 3 after completing printing area X to the start-driving position y2 (start-printing position)

for printing area Y is greater than or equal to the distance required to decelerate to the normal print velocity V0 before position y2 after accelerating the carriage 3 from the stop-driving position x2 to velocity Vac, a transportation pattern that uses acceleration to velocity Vac to convey the carriage 3 from the stop-driving position x2 to the start-driving position y2 is selected.

Figure 12:
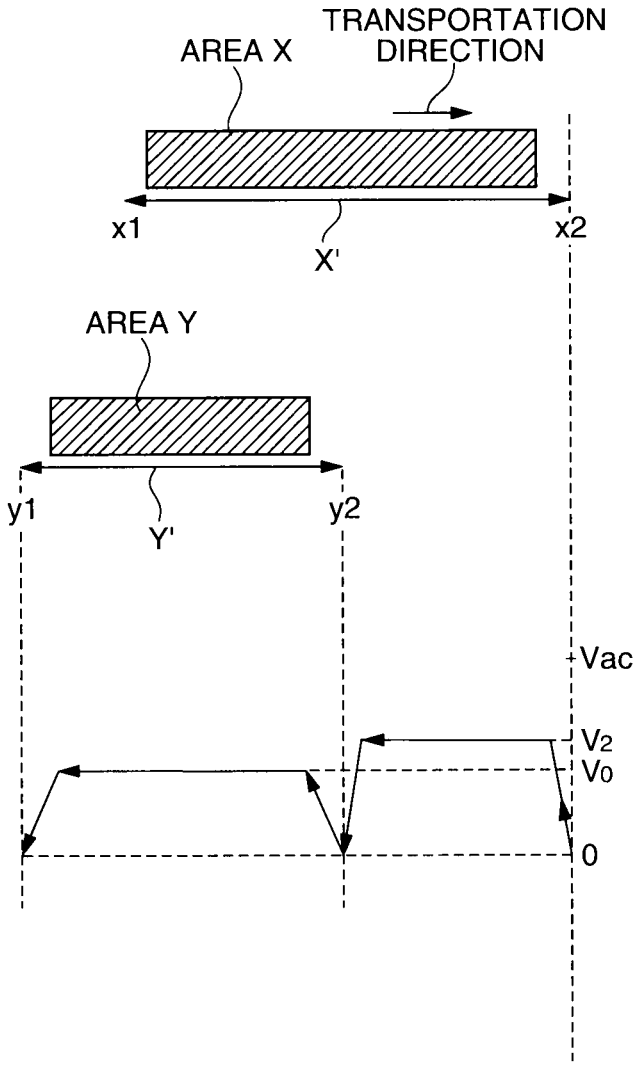
FIG. 12 shows another example of the specific relative positions of area X and area Y in a pattern in which area X and area Y are printed in opposite directions, and the relationship between the transportation position and velocity of the carriage 3 when printing area Y.
Figure 13:
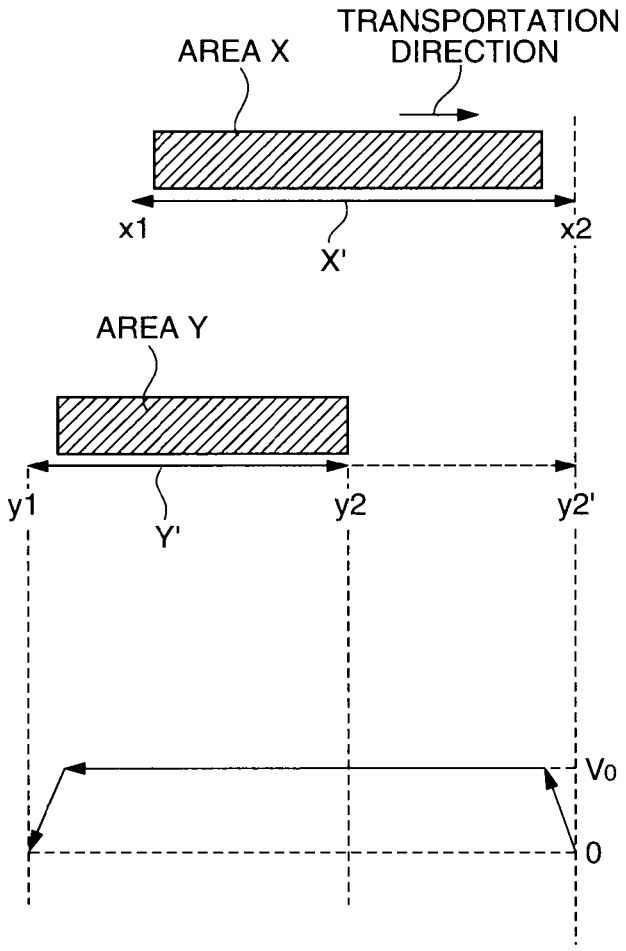
FIG. 13 shows yet another example of the specific relative positions of area X and area Y in a pattern in which area X and area Y are printed in opposite directions, and the relationship between the transportation position and velocity of the carriage 3 when printing area Y.

If in the same pattern (A) (reverse printing) the distance from the stop-driving position x2 to the start-driving position y2 is short and acceleration to velocity Vac cannot be used, the selection candidates include the transportation pattern shown in FIG. 12 and the transportation pattern shown in FIG. 13.

The transportation pattern shown in FIG. 12 conveys the carriage 3 to the start-driving position y2 by logic seeking at a transportation velocity V2 that is slower than velocity Vac but requires a shorter distance for acceleration and deceleration as shown in the figure.

The transportation pattern shown in FIG. 13 uses position y2' as the start-driving position of the carriage 3 when printing area Y, and conveys the carriage 3 at the normal print velocity V0 used for printing. This position y2' is reached by indexing the print medium one line in the primary scanning direction after the carriage 3 reaches the stop-driving position x2.

When there is not enough distance for acceleration and deceleration using velocity Vac, the transportation pattern shown in FIG. 12 conveys the carriage 3 at a velocity V2 that is slower than velocity Vac but requires a shorter distance for acceleration and deceleration.

Figure 14:
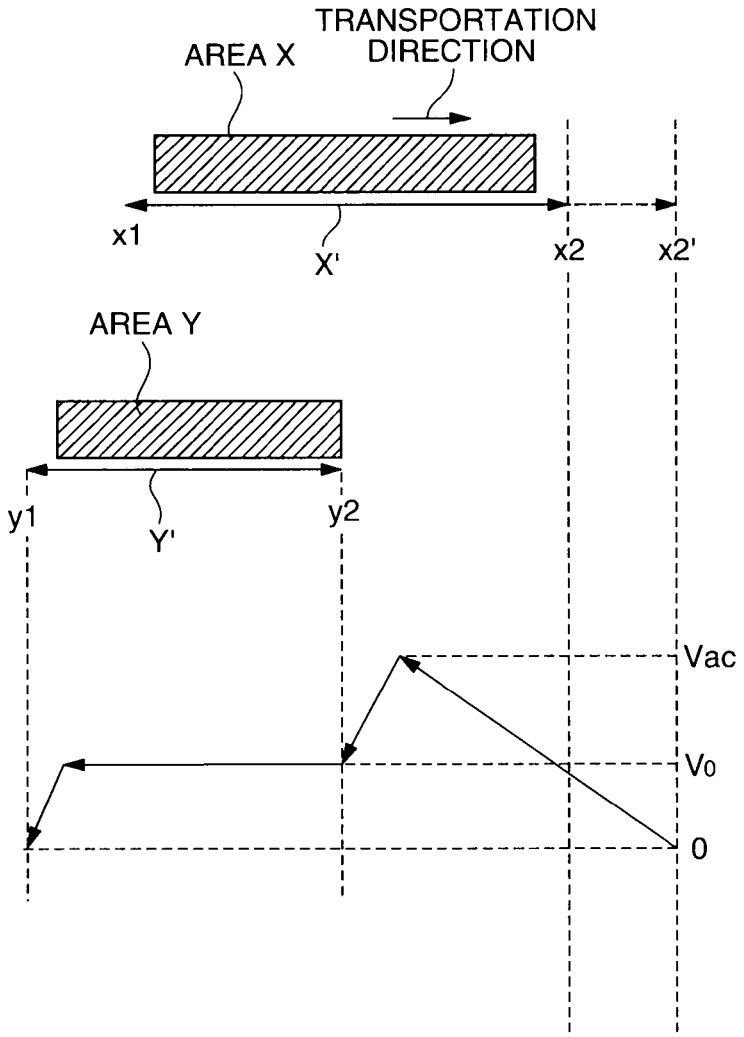
FIG. 14 shows yet another example of the specific relative positions of area X and area Y in a pattern in which area X and area Y are printed in opposite directions, and the relationship between the transportation position and velocity of the carriage 3 when printing area Y.

Another selection candidate in this scenario is the transportation pattern shown in FIG. 14. In order to provide enough distance to convey the carriage 3 to the start-driving position y2 using acceleration to velocity Vac, this transportation pattern changes the stop-driving position of the carriage 3 after finishing printing area X to a position x2' that is past position x2.

Figure 15:
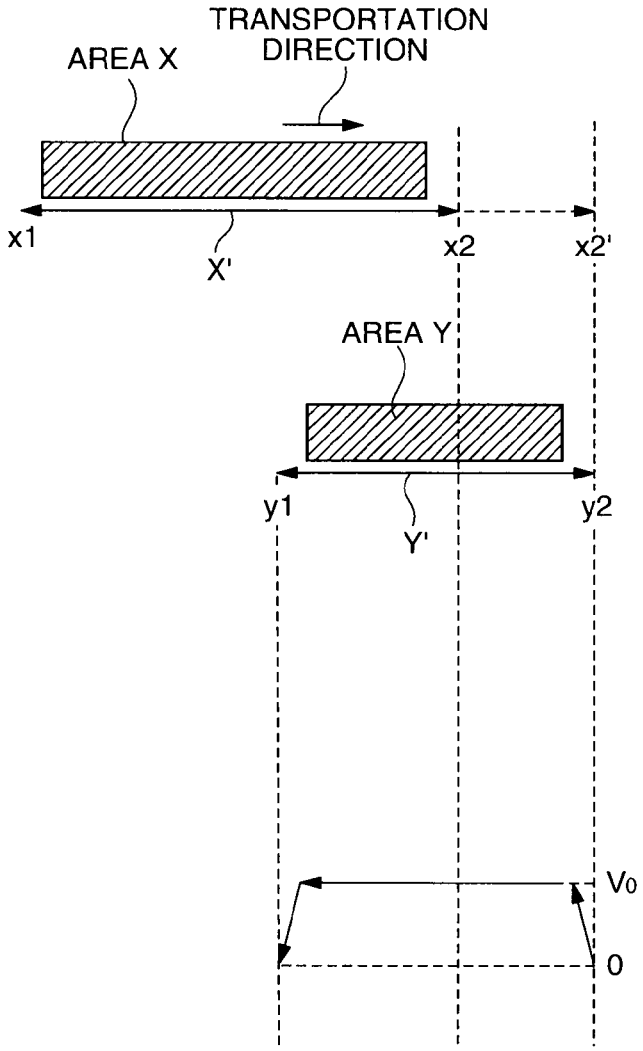
FIG. 15 shows an example of the specific relative positions of area X and area Y in a pattern in which area Y can be printed in either the same direction or the opposite direction as area X, and the relationship between the transportation position and velocity of the carriage 3 when printing area Y.

Next, the selection candidates in the case of pattern (B) above in which area Y and area X may be printed in the same or opposite directions include the transportation pattern shown in FIG. 15. As shown in FIG. 15, this transportation pattern changes the stop-driving position of the carriage 3 after finishing printing area X to a position x2' beyond position x2 so that the stop-driving position of the carriage 3 after completing printing area X matches the start-driving position y2 after the paper feed operation and the carriage 3 can be accelerated to velocity V0 and moved to print area Y.

Figure 16:
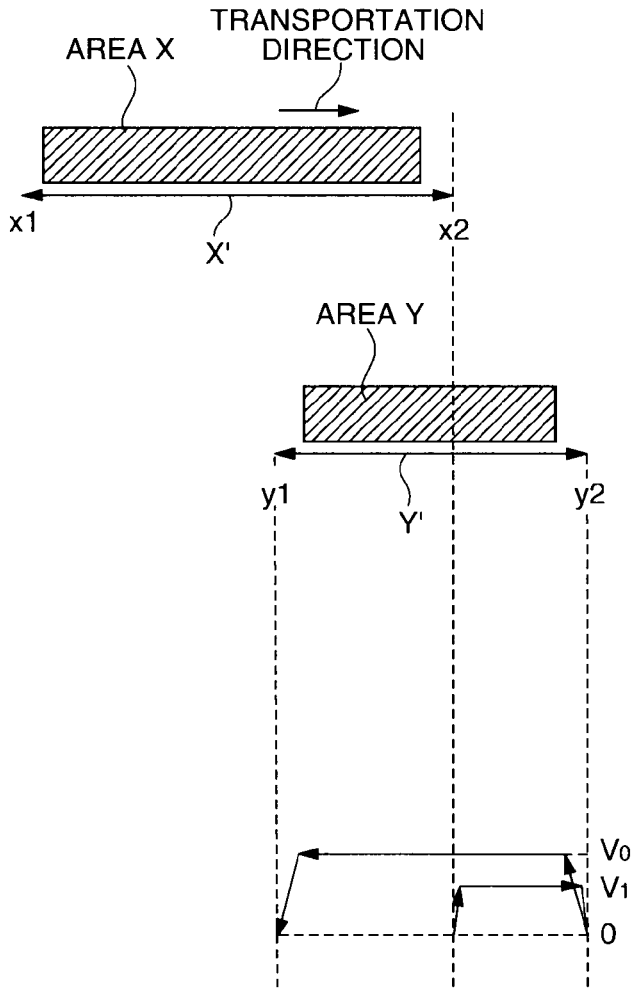
FIG. 16 shows another example of the specific relative positions of area X and area Y in a pattern in which area Y can be printed in either the same direction or the opposite direction as area X, and the relationship between the transportation position and velocity of the carriage 3 when printing area Y.
Figure 17:
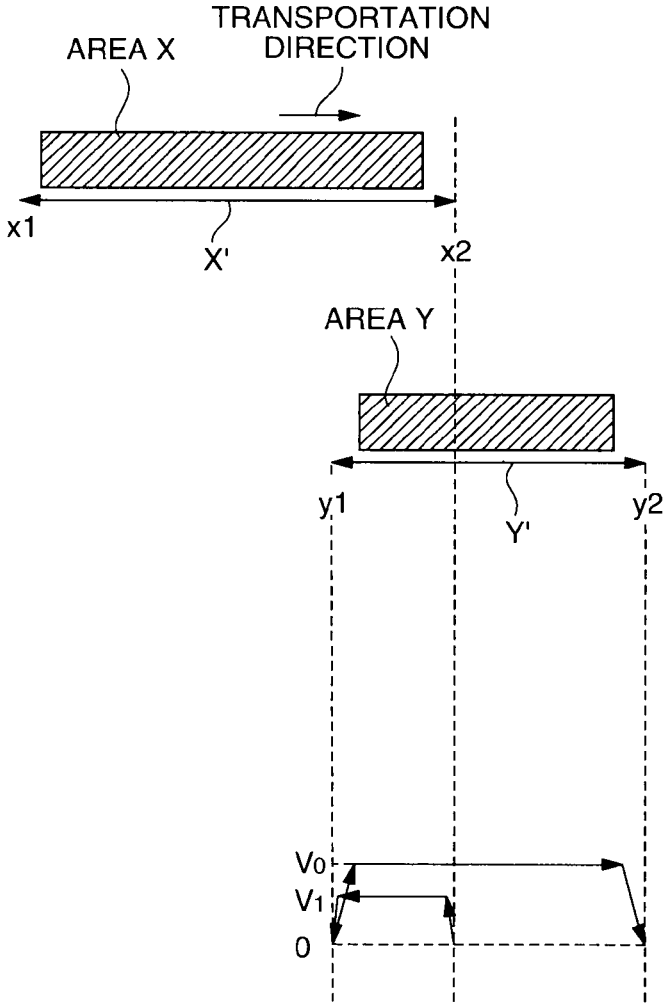
FIG. 17 shows yet another example of the specific relative positions of area X and area Y in a pattern in which area Y can be printed in either the same direction or the opposite direction as area X, and the relationship between the transportation position and velocity of the carriage 3 when printing area Y.

Transportation patterns that do not change the stop-driving position of the carriage 3 from position x2 after printing area X is completed and could be selected in the case of the above pattern (B) are shown in FIG. 16 and FIG. 17.

If the distance that can be used for acceleration and deceleration between the stop-driving position x2 of area X and the end y1 or y2 of the carriage 3 drive range Y' for printing area Y in the same direction as the direction of carriage 3 travel when printing area X is short, the transportation pattern shown in FIG. 16 uses a transportation velocity V1 that is slower and requires less distance for acceleration and deceleration than velocity V2. Alternatively, a transportation pattern that logic seeks a position in the opposite direction as shown in FIG. 17 could be used.

If the distance that can be used for acceleration and deceleration in the patterns shown in FIG. 16 and FIG. 17 enables using velocity V2, the carriage 3 can be conveyed at the higher velocity V2 instead of at velocity V1.

Figure 18:
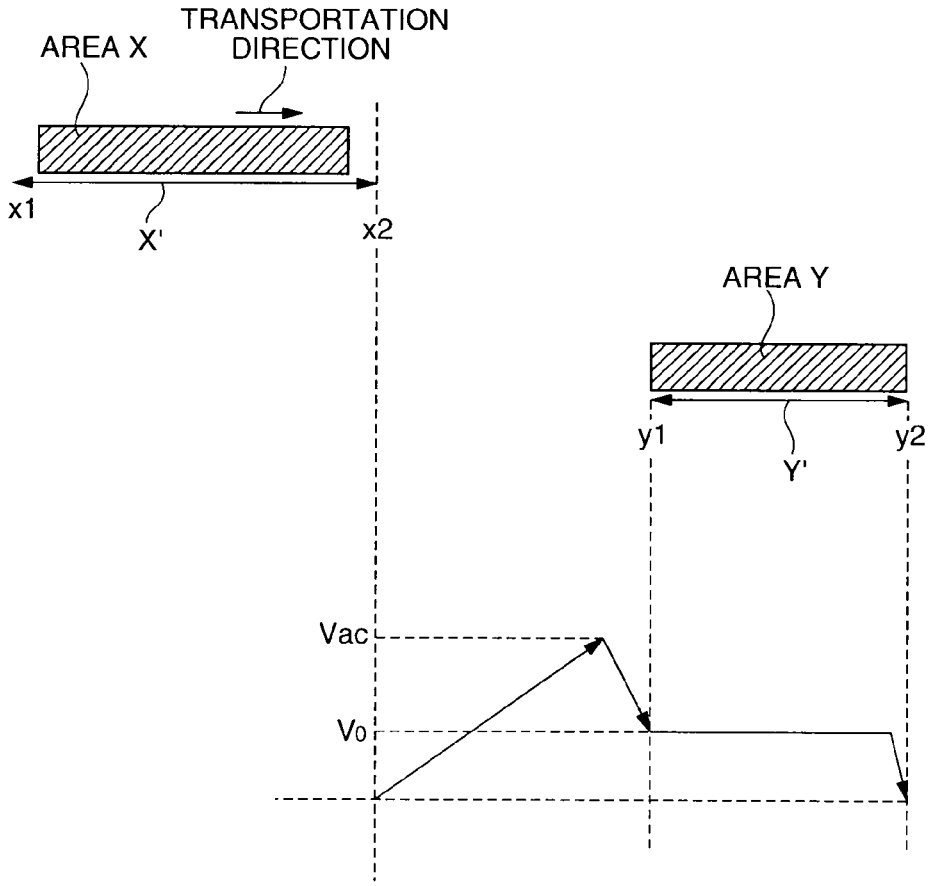
FIG. 18 shows an example of the specific relative positions of area X and area Y in a pattern in which area X and area Y are printed in the same direction, and the relationship between the transportation position and velocity of the carriage 3 when printing area Y.

In the case of pattern (C) above in which area X and area Y are printed in the same direction, the transportation pattern shown in FIG. 18 may be selected. This transportation pattern uses acceleration to velocity Vac to convey the carriage 3 from the stop-driving position x2 to the start-driving position y1 when the distance from the stop-driving position x2 of the carriage 3 after printing area X ends to the start-driving position y1 of the carriage 3 for printing area Y is greater than or equal to the distance required to decelerate to the normal print velocity V0 before position y1 after accelerating the carriage 3 from the stop-driving position x2 to velocity Vac.

Figure 19:
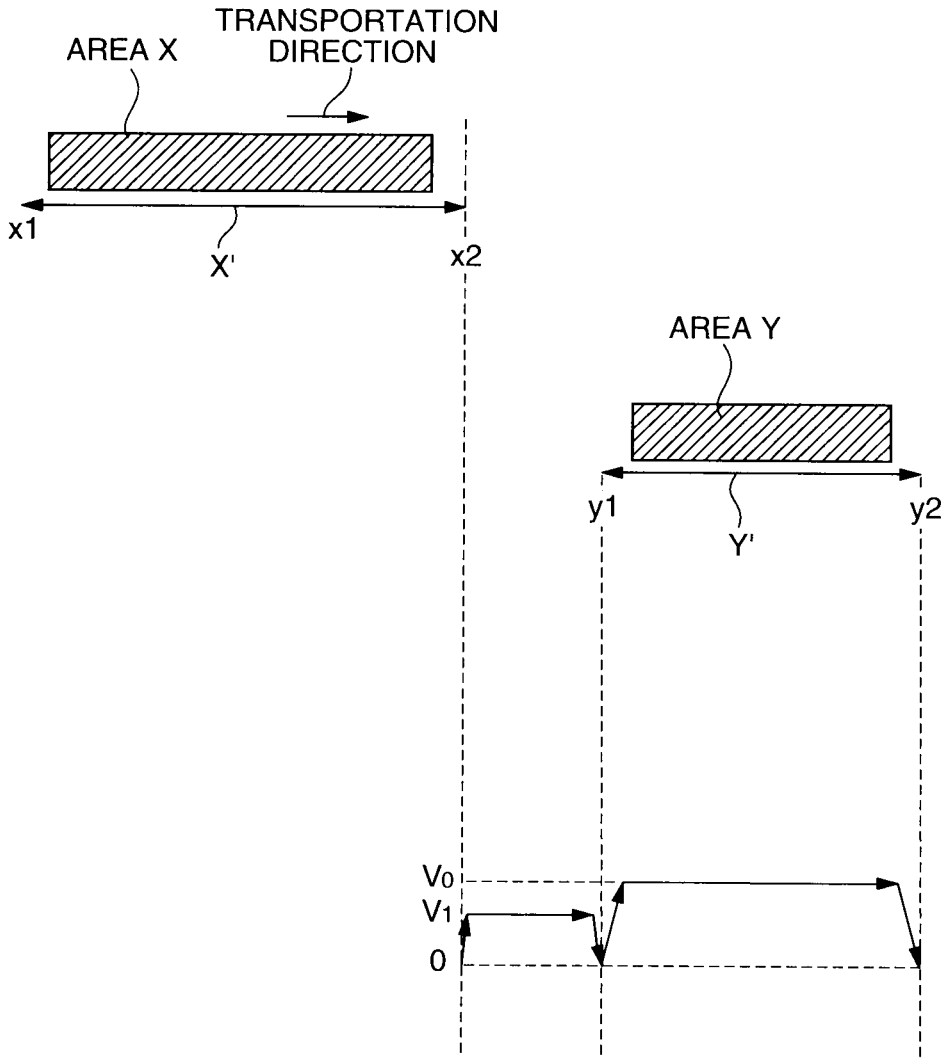
FIG. 19 shows another example of the specific relative positions of area X and area Y in a pattern in which area X and area Y are printed in the same direction, and the relationship between the transportation position and velocity of the carriage 3 when printing area Y.
Figure 20:
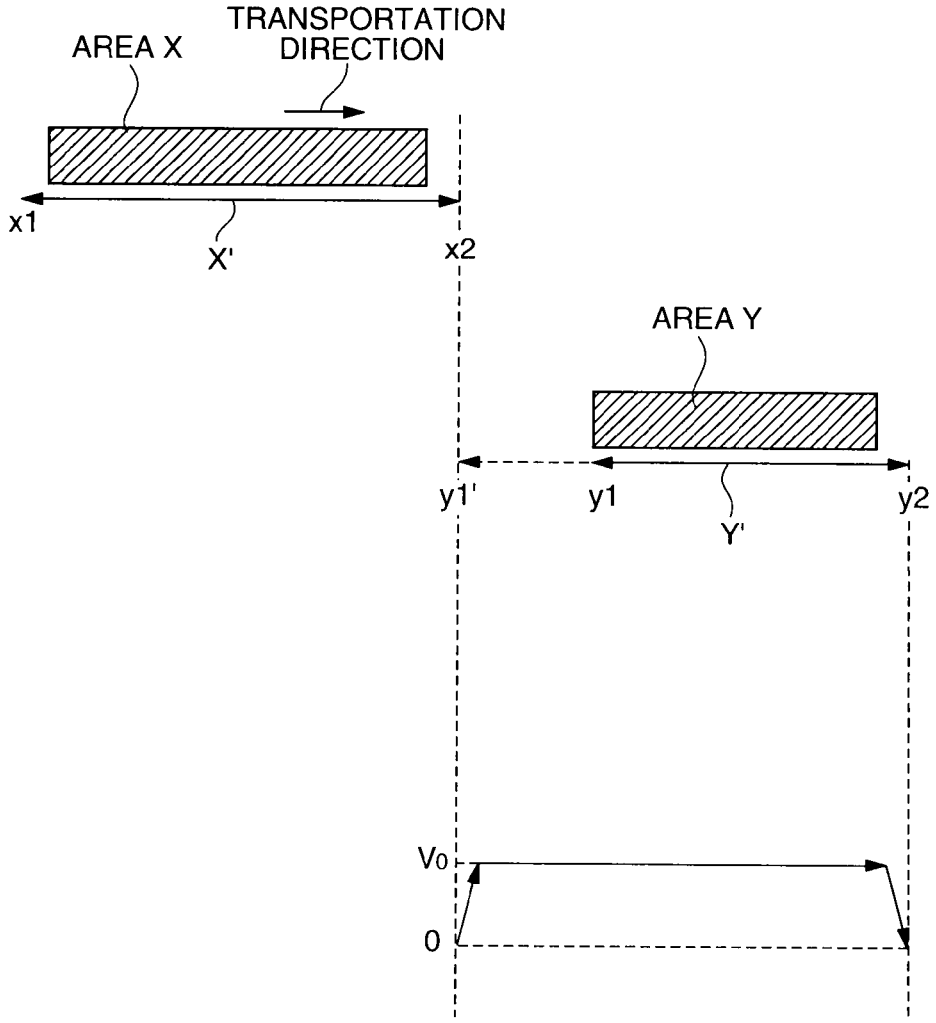
FIG. 20 shows yet another example of the specific relative positions of area X and area Y in a pattern in which area X and area Y are printed in the same direction, and the relationship between the transportation position and velocity of the carriage 3 when printing area Y.

If the distance from the stop-driving position x2 to the start-driving position y1 is short and acceleration to velocity Vac cannot be used in this same pattern (C) (printing in the same direction), the transportation pattern shown in FIG. 19 and the transportation pattern shown in FIG. 20 could be selected.

The transportation pattern shown in FIG. 19 conveys the carriage 3 at logic seeking velocity V1 to the start-driving position y1.

The transportation pattern shown in FIG. 20 sets position y1', which is reached by indexing the recording medium one line in the primary scanning direction when the carriage 3 reaches the stop-driving position x2, as the start-driving position of the carriage 3 for printing area Y, and accelerates to velocity V0 to seek and print area Y.

When the distance in FIG. 19 for acceleration and deceleration is sufficient to enable using velocity V2, the carriage 3 can be conveyed at the faster velocity V2 instead of velocity V1.

Figure 21:
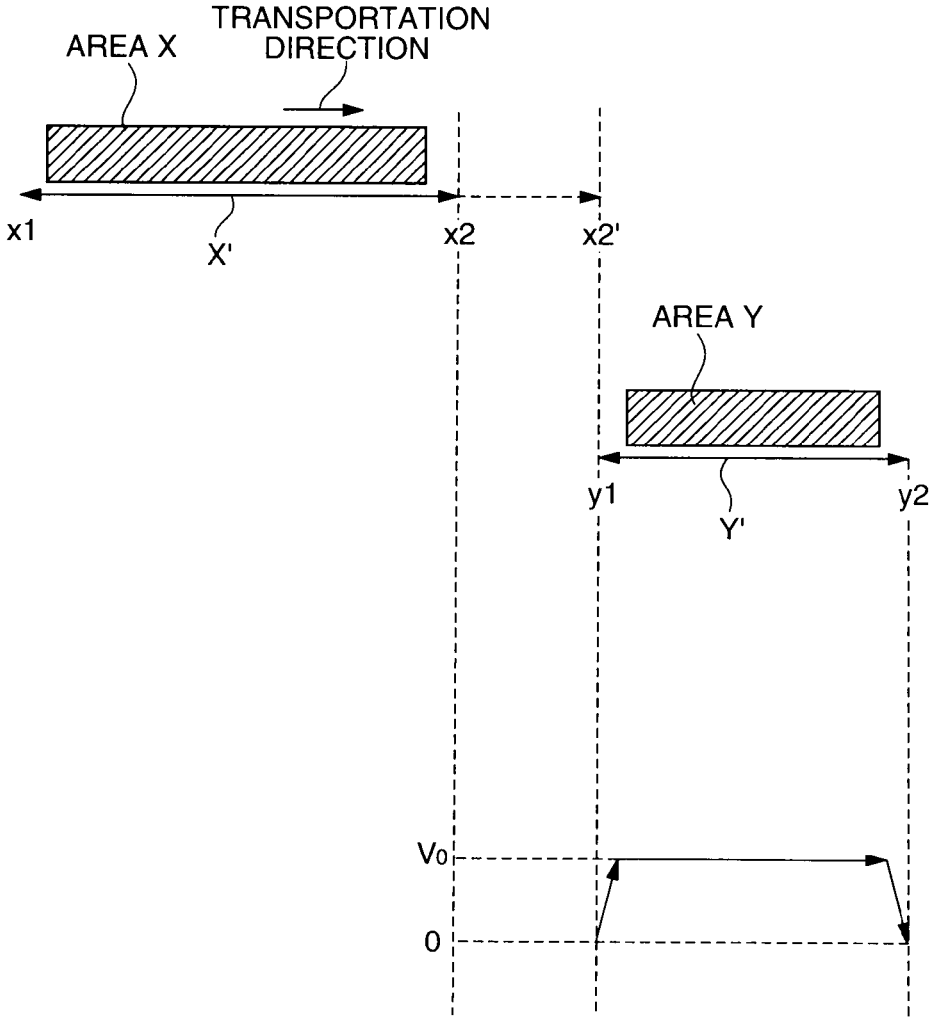
FIG. 21 shows yet another example of the specific relative positions of area X and area Y in a pattern in which area X and area Y are printed in the same direction, and the relationship between the transportation position and velocity of the carriage 3 when printing area Y.

Further alternatively, the transportation pattern shown in FIG. 21 could be selected. In this transportation pattern the stop-driving position of the carriage 3 after printing area X ends is moved beyond position x2 to position x2' at the same velocity V0 so that the stop-driving position of the carriage 3 after finishing printing area X matches the start-driving position y1 after the recording medium is advanced.

The CPU 16 selects the transportation pattern with the shortest required time from among the transportation patterns that are selection candidates in each of the foregoing scenarios, and sets the start-driving position of the carriage 3 for starting printing area Y accordingly.

Although the present invention has been described in connection with preferred embodiments thereof with reference to the accompanying drawings, various changes and modifications will be apparent to those skilled in the art in light of the foregoing disclosure. Any and all such changes and modifications are to be understood as included within the scope of the present invention to the extent they fall within the scope of the claims of this application.

What is claimed is:

1. A printing device, comprising:

a print unit configured to print on a print medium;

a first transportation unit configured to convey the print medium in a primary scanning direction;

a second transportation unit configured to convey the print unit in a secondary scanning direction substantially perpendicular to the primary scanning direction at a first transportation speed or a second transportation speed that is faster than the first transportation speed; and a control unit configured to control the transportation operations of the first transportation unit and the second transportation unit after a first print area is printed at the first transportation speed and to determine whether a start-printing position is a first position in a next print area in the secondary scanning direction or a second position in the next print area in the secondary scanning direction based on a first distance from a stop-printing position where the print unit finishes printing the first print area to the first position, a second distance from the stop-printing position to the second position, and a third distance needed to accelerate the speed of the second transportation unit from the first transportation speed to the second transportation speed;

wherein, when a transportation distance of the print unit from the stop-printing position to the start-printing position, as determined by the control unit, is greater than or equal to a specified distance, the control unit is configured to set the transportation speed of the print unit at the second transportation speed.

2. The printing device described in claim 1, wherein, when the stop-printing position in the secondary scanning direction is within a range of the next print area in the secondary scanning direction, the control unit determines whether the start-printing position is the first position or the second position based on a transportation direction of the print unit.

3. The printing device described in claim 1, wherein, in the determination by the control unit of whether a start-printing position is a first position in a next print area in the secondary scanning direction or a second position in the next print area in the secondary scanning direction such determination is also based on a fourth distance needed to accelerate transportation of the second transportation unit from the first transportation speed.

4. A printing device, comprising:

a print unit configured to print on a print medium;

a first transportation unit configured to convey the print medium in a primary scanning direction;

a second transportation unit configured to convey the print unit in a secondary scanning direction substantially perpendicular to the primary scanning direction at a first transportation speed or a second transportation speed that is faster than the first transportation speed; and a control unit configured to control the transportation operations of the first transportation unit and the second transportation unit after a first print area is printed at the first transportation speed and to determine whether a start-printing position is a first position in a next print area in the secondary scanning direction or a second position in the next print area in the secondary scanning direction based on a first distance from a stop-printing position where the print unit finishes printing the first print area to the first position, a second distance from the stop-printing position to the second position, and a third distance needed to accelerate, the speed of the second transportation unit from the first transportation speed to the second transportation speed;

wherein, when a distance from the stop-printing position to the first position is shorter than the specified distance, the control unit:

calculates and compares the time required by a scenario in which the print unit is conveyed from the stop-printing position to the first position at the first transportation speed, and a scenario in which the print unit is conveyed from the stop-printing position past the first position to the second position at the second transportation speed, and selects the scenario with the shorter required time.

5. A printing method, comprising:

conveying a print medium in a primary scanning direction;

printing a first print area in the print medium at a first transportation speed;

determining whether a start-printing position is a first position in a next print area in a secondary scanning direction or a second position in the next print area in the secondary scanning direction based on a first distance from a stop-printing position where a print unit finishes printing the first print area to the first position, a second distance from the stop-printing position to the second position, and a third distance needed to accelerate transportation of a second transportation unit from the first transportation speed to a second transportation speed that is faster than the first transportation speed;

conveying the print unit from the stop-printing position to the start-printing position, as determined in the determining step; and printing the next print area from the determined start-printing position in the secondary scanning direction;

wherein, when a transportation distance of the print unit from the stop-printing position to the determined start-printing position is greater than or equal to a specified distance, the method further comprises conveying the print unit at the second transportation speed.

6. The printing method described in claim 5, wherein, when a distance from the stop-printing position to the first position is shorter than the specified distance, the determining step further comprises:

calculating and comparing the time required by a scenario in which the print unit is conveyed from the stop-printing position to the first position at the first transportation speed, and a scenario in which the print unit is conveyed from the stop-printing position past the first position to the second position at the second transportation speed, and selecting the scenario with the shorter required time.

7. The printing method described in claim 5, wherein, when the stop-printing position in the secondary scanning direction is within a range of the next print area in the secondary scanning direction, the determining is also based on a transportation direction of the print unit.

8. The printing method described in claim 5, wherein, the determining is also based on a fourth distance needed to accelerate transportation of the second transportation unit from the first transportation speed.

* * * * *